United States Patent [19]

Sekiguchi

[11] 4,275,369

[45] Jun. 23, 1981

[54] FILTER FOR MICROWAVES

[75] Inventor: Mitsuo Sekiguchi, Soma, Japan

[73] Assignee: Alps Electric Co., Ltd., Tokyo, Japan

[21] Appl. No.: 61,415

[22] Filed: Jul. 27, 1979

[30] Foreign Application Priority Data

Aug. 2, 1978 [JP] Japan ..... 53-106318[U]

[51] Int. Cl.[3] ..... H01P 1/20; H01P 1/208

[52] U.S. Cl. ..... 333/209; 333/212

[58] Field of Search ..... 333/208–212, 333/203

[56] References Cited

U.S. PATENT DOCUMENTS

| | | | |
|---|---|---|---|
| 3,955,111 | 5/1976 | MacTurk | 333/208 |
| 4,037,182 | 7/1977 | Burnett et al. | 333/209 |

*Primary Examiner*—Eli Lieberman

*Attorney, Agent, or Firm*—Guy W. Shoup; Gerard F. Dunne

[57] ABSTRACT

A filter for microwaves includes a plurality of resonator cavities each having a housing formed unitarily with a respective resonance rod. The neighbouring resonator cavities are coupled together by means of a coupling window formed in the wall separating the cavities and a coupling loop, and a hole communicating with the coupling window is formed in the bottom plate of the filter.

4 Claims, 6 Drawing Figures

Fig. 3A
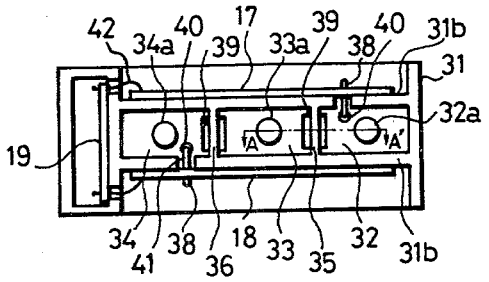
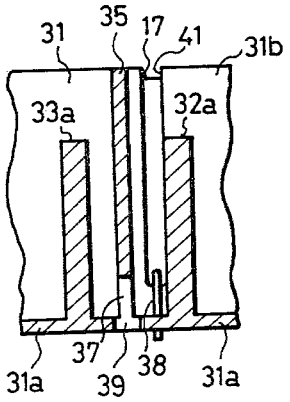
Fig. 3B
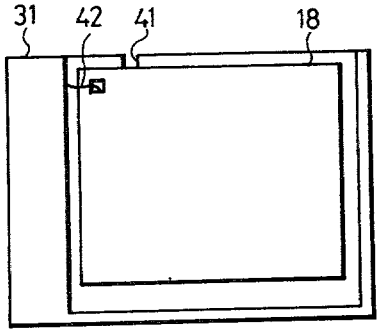
Fig. 3C

FILTER FOR MICROWAVES

The present invention relates to filters for microwaves.

Double superheterodyne tuners often include microwave filters such as that illustrated in FIG. 2, wherein reference numeral 20 represents a housing portion for a plurality of resonator cavities 21 to 23. The individual resonator cavities 21 to 23 each have respective resonance rods 21*a* to 23*a* having end portions extending through respective openings formed in the bottom wall of the housing 20 and adapted to be fastened thereto by a respective nut. Coupling windows 26 are formed respectively in wall 24 between the resonator cavities 21 and 22, and the wall 25 between the resonator cavities 22 and 23. Further, coupling loops 27 are provided in the resonator cavities 21 to 23 to thereby couple the resonator cavities by means of the coupling windows 26 and the coupling loops 27. Moreover, referring to FIG. 2 (B), a cover 28 is brought into contact with the side of the housing 20 for covering the side of each resonator cavity to thereby provide the entire housing for the resonator cavities 21 to 23. Holes 29 for the coupling loops 27 are formed in portions of the resonator cavities 21 and 23 and a bolt 30 is often provided for adjusting the resonance frequency of each cavity.

With the conventional filters for microwaves as mentioned above, the resonance rods 21*a* to 23*a* are typically fastened to the housing 20 by nuts, and the housing for the resonator cavities 21 to 23 typically has been formed by the housing of the tuner and the separate cover 28. When the device is constructed as mentioned above, however, it is difficult to bring the cover 28 reliably into proper contact with the housing 20 of the tuner. In addition, fastening of the cover must be attained by using many screws. Furthermore, the resonance rods 21*a* to 23*a*, which are required to satisfy major requirements for resonance of the resonators 21 to 23, are not formed together with the tuner housing 20 as a unitary structure. Therefore, the contact at the base portions of the resonance rods 21*a* to 23*a* may lose stability and, since the base portions will be normally subjected to the greatest high-frequency potential, this loss of stability can become extremely worrisome. Importantly, the transmission losses can become great when the filter is resonated at ultrahigh frequencies of, for example, 2 to 3 GHz and further, the resonance frequency may be changed by mechanical vibration and impact, making it difficult to obtain the frequency characteristics desired for the filter.

Accordingly, an object of the present invention is to provide a microwave filter which minimizes transmission losses and always exhibits the frequency characteristics desired without increasing the cost or complexity of the filter.

Accordingly to the present invention, a microwave filter is provided which includes a plurality of resonance rods formed unitarily within respective resonator cavities coupled together. Other features and advantage of the present invention will become apparent in view of the following detailed description of an illustrative embodiment and accompanying drawings, in which:

FIGS. 3A and 3B illustrate a microwave filter according to an embodiment of the present invention, wherein the 3A is an upper plan view, 3B is a cross-sectional view taken along the line A—A' of FIG. 3A, and FIG. 3C is a side view.

Figure 1:
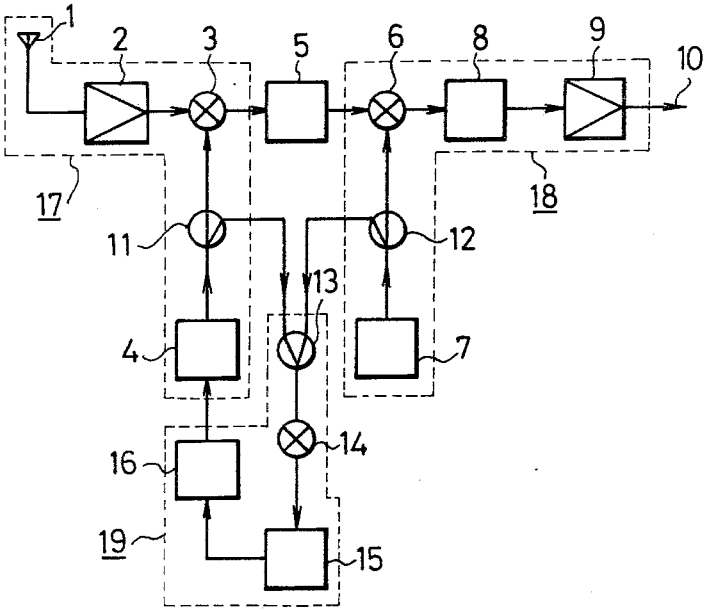
FIG. 1 is a circuit diagram of a double superheterodyne tuner in which is applied a microwave filter according to the present invention.
Figure 2A:
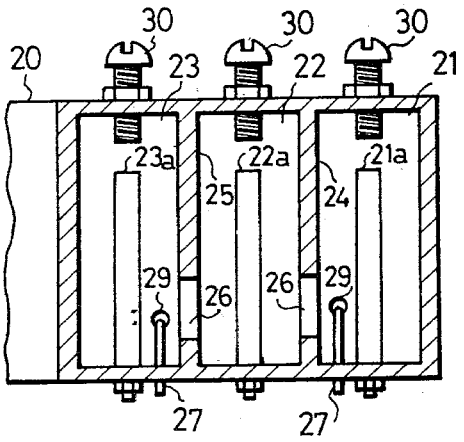
Fig. 2A PRIOR ART
FIGS. 2A and 2B are diagrams to illustrate a conventional filter for microwaves.
Figure 2B:
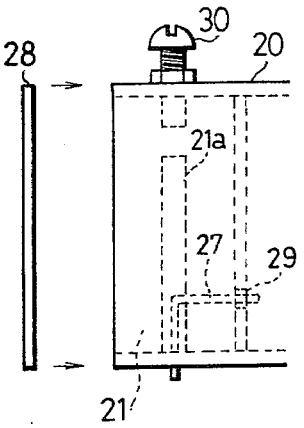
Fig. 2B PRIOR ART

FIG. 1 is a circuit diagram of a double superhetereodyne tuner having a microwave filter. The tuner includes an antenna 1, an amplifier 2, a first mixer 3, a variable oscillator 4, a first intermediate frequency filter 5 made up of a filter for microwaves, a second mixer 6, a fixed oscillator 7, a second intermediate frequency filter 8, a second intermediate frequency amplifier 9, an output terminal 10, a distributor 11, a distributor 12, a synthesizer 13, a phase locked loop (PPL) mixer 14, a low-pass filter 15, a PLL block 16, an IC board 17, an IC board 18, and an IC board 19.

The IC board 17 includes the circuits necessary to add the input signals from the antenna 1 to the amplifier 2, to mix in the first mixer 3 the output of the amplifier with a portion of the output of the variable oscillator 4 distributed by the distributor 11, and to direct the resulting mixed output of the mixer 3 to the first intermediate frequency filter 5.

The IC board 18 includes the circuits necessary to mix, by way of the second mixer 6, the first intermediate frequency signals leaving the first intermediate frequency filter 5 together with a portion of the output of the fixed oscillator 7 distributed by the distributor 12, to direct the mixed output to the second intermediate frequency filter 8, and to amplify by means of the amplifier 9 the second intermediate frequency signals produced by the second intermediate frequency filter 8 thereby to produce the amplified output at the terminal 10.

The IC board 19 includes the circuits necessary to synthesize, by means of the synthesizer 13, a portion of the output of the variable oscillator 4 distributed by the distributor 11 in the IC board 17 and a portion of the output of the fixed oscillator 7 distributed by the distributor 12 in the IC board 18. Further, the IC board 19 has circuitry to convert the output of the synethesizer 13 through the PLL mixer 14, and to select, from the converted output and by means of the low-pass filter 15, only low frequencies corresponding to the limiting frequency of a frequency divider incorporated in the PLL block 16, as will be described more fully below. The IC board 19 also includes circuitry to pass the output of the low-pass filter 15 to the PLL block 16 to thereby control the variable oscillator 4 in the IC board 17.

The PLL block 16 is typical of known PLL arrangements and includes a variable frequency divider, a program switch, a phase detector, a reference signal generator and a low-pass filter. The PLL circuit is established by a closed circuit including the PLL block 16 and the abovementioned variable oscillator 4, PLL mixer 14, and low-pass filter 15.

In receiving a desired channel, if the difference between a frequency of the variable oscillator 4 and a frequency of the fixed oscillator is maintained at a constant value, the output of the terminal 10 is always maintained constant.

A double superheterodyne tuner can therefore be obtained by connecting the abovementioned IC boards 17, 18 and 19 with the first intermediate frequency filter 5, which serves as a microwave filter, as illustrated.

The microwave filter of the present invention is illustrated in FIG. 3 and includes a housing 31 containing a plurality of resonator cavities 32 to 34. The resonator cavities 32 to 34 each have respective resonance rods 32*a* to 34*a* that are formed together with the housing 31 as a unitary structure, as shown most clearly in FIG. 3B.

The housing and unitary resonance rods are preferably die cast from an aluminum alloy to provide a housing with low surface resistance. The alloy may have either of the two compositions set forth below.

| Composition A | |
|---|---|
| Cu | 0.6% |
| Fe | 1.3 |
| Si | 11.0 to 13.0 |
| Mn | 0.3 |
| Mg | 0.1 |
| Zn | 0.5 |
| Ni | 0.5 |
| Sn | 0.1 |
| Al | remainder |
| **Composition B** | |
| Cu | 2.0 to 4.5% |
| Fe | 1.3 |
| Si | 10.5 to 12.0 |
| Mn | 0.5 |
| Mg | 0.3 |
| Zn | 1.0 |
| Ni | 0.5 |
| Sn | 0.35 |
| Al | remainder |

Further, a coupling window 37 is formed in the housing wall 35 between the resonator cavity 32 and the resonator cavity 33, and a coupling window is also formed in the housing wall 36 between the resonator cavity 33 and the resonator cavity 34. Coupling loops 38 are disposed in the resonator cavity 32 and in the resonator cavity 34, whereby the resonator cavities are coupled by means of the coupling windows 37 and the coupling loops 38. Furthermore, as shown in FIG. 3B, the bottom wall 31*a* is provided with a hole 39 communicating with the coupling window 37 of the wall 35, and, although not shown in the drawings, a similar hole in the bottom wall 31*a* communicates similarly with the coupling window in the housing wall 36. In the resonator cavities 32 and 34, a hole 40 is formed in the bottom wall 31*a* and is positioned outside of the respective holes communicating with the walls 35 and 36. A groove 41 is formed in the side wall 31*b* and the coupling loop 38 runs through the hole 40 and the groove 41. Reference numerals 17, 18 and 19 represent IC boards corresponding to the IC boards having the same reference numerals FIG. 1. The input signals from the IC board 17 are introduced from the coupling loop 38 on the right side of FIG. 3A, and are subsequently fed to the IC board 18 through the coupling loop 38 located on the left side. Reference numeral 42 denotes connection lines connecting the IC boards together.

As mentioned in the foregoing, the filter for microwaves of the present invention comprises resonator cavities 32 to 34 having resonance rods 32*a* to 34*a* and the housing 31 as a unitary structure, wherein the neighbouring resonators are coupled together by means of the coupling windows 37 formed in the walls 35 and 36 separating the resonator cavities, and the coupling loop 38, and the holes 39 communicated with the coupling windows 37 formed in the bottom wall 31*a*. Therefore, even when mechanical vibration or impact is imparted to the filter, the contacting states of the resonance rods 32*a* to 34*a* can be stably maintained with respect to the housing 31. Consequently, transmission losses can be minimized, and the resonating state can be stably maintained even in the high frequency band of 2 to 3 GHz making it possible to obtain any preset frequency characteristics. Besides, the coupling loop 38 can be easily adjusted through the hole 39 communicated with the coupling window 37. With the thus constructed filter for microwaves of the present invention, the number of parts and the assembling steps can be greatly reduced, to increase consistancy in quality.

What is claimed is:

1. A filter for signals in the microwave frequencies, comprising a housing forming a plurality of resonator cavities separated by respective side walls therebetween, said housing including a bottom wall and each of said cavities having a respective resonance rod formed unitarily with said bottom wall, means including windows formed in said side walls for coupling said cavities together, coupling loops extending respectively into the two end resonator cavities at locations therein adjacent said bottom wall, and holes formed in said bottom wall at locations adjacent said coupling loops.

2. A filter according to claim 1, said housing and said resonance rods being die cast from an aluminum alloy.

3. A filter according to claims 1 or 2, said holes being formed contiguous to the windows leading to the respective end resonator cavities.

4. A filter according to claim 3, said coupling loops extending through respective elongate grooves in said housing.

* * * * *